United States Patent [19]

Haddock, Jr.

[11] Patent Number: 4,495,674

[45] Date of Patent: Jan. 29, 1985

[54] CONCEALED DOOR HINGE HAVING A DOUBLE PIVOTAL MOUNTING

[75] Inventor: Louis A. Haddock, Jr., Battle Creek, Mich.

[73] Assignee: Clark Equipment Company, Buchanan, Mich.

[21] Appl. No.: 355,008

[22] Filed: Mar. 5, 1982

[51] Int. Cl.[3] ..... E05F 1/08

[52] U.S. Cl. ..... 16/302; 16/86 R; 16/282; 16/289; 16/306; 16/371

[58] Field of Search ..... 16/86 R, 280–282, 16/288, 289, 297, 302, 306, 319, 321, 370, 371, 374, DIG. 7; 49/379

[56] References Cited

U.S. PATENT DOCUMENTS

| | | | |
|---|---|---|---|
| 521,772 | 6/1894 | Vaughan, Jr. . | |
| 1,886,934 | 11/1932 | Atwood | 16/86 R |
| 2,177,826 | 10/1939 | Hansen | 16/163 |
| 2,674,761 | 4/1954 | Weiss | 16/288 |
| 2,870,477 | 1/1959 | Anthony et al. | 16/164 |
| 2,909,254 | 10/1959 | Hallook | 49/386 |
| 3,085,297 | 4/1963 | Linderfelt | 20/16 |
| 3,651,539 | 3/1972 | Breunich | 16/128 |
| 3,921,252 | 11/1975 | Guth | 16/281 |
| 4,134,179 | 1/1979 | Silaghi | 16/289 X |
| 4,223,420 | 9/1980 | Yukimoto et al. | 16/288 |

*Primary Examiner*—Fred Andrew Silverberg
*Attorney, Agent, or Firm*—Kenneth C. Witt; John C. Wiessler

[57] ABSTRACT

A hinge mechanism for a door which includes a support within the door opening and away from the door jamb. In the closed position of the door, parts of the mechanism including a hinge member are located between the support and the jamb. A door is pivotally mounted on the hinge member at its distal end. As the door moves from the closed to an intermediate position the pivotal mounting of the door on the hinge member follows an arcuate path outwardly and away from the door jamb. When the mechanism reaches the intermediate position the door can be swung on its pivotal connection with the hinge member to a fully open position.

6 Claims, 10 Drawing Figures

CONCEALED DOOR HINGE HAVING A DOUBLE PIVOTAL MOUNTING

BACKGROUND OF THE INVENTION

1. Field of the Invention

This invention relates to hinge mechanisms for doors and particularly to such mechanisms which permit the door to be opened 180 degrees.

2. Description of the Prior Art

U.S. Pat. No. 521,772 discloses a mechanism employing a double pivot adjacent the jamb to allow a flush door to be opened 180°. The double pivot involves a short link which connects recessed lugs on the frame with lugs on the door.

U.S. Pat. No. 2,177,826 shows an external compound action hinge construction which includes a link pivotally connected to the frame at one end and to the door at the other. There is a cam arrangement associated with the latter pivot connection which causes the latter connection to operate last when the door is closed and first when it is opened, to avoid interference between the inner corner of the door and the outer corner of the door frame during both opening and closing of the door.

In U.S. Pat. No. 2,870,477 a hinge arm pivotally connects the door and a truck body, the hinge arm extending through the door jamb. There is a cam detent mechanism between the hinge arm and the body and a second cam detent mechanism between the hinge arm and the door. When the door is moved from the closed position toward open the first mentioned detent mechanism yields first so that the door and hinge arm initially pivot as a unit with respect to the body. When the hinge arm reaches the end of its travel the second detent yields and the door then pivots with respect to the hinge arm to enable the door to reach the fully open position. When the door is closed the second detent yields first, causing the door to pivot first with respect to the hinge arm, after which the first detent yields and the door and hinge arm then move as a unit to the door closed position.

U.S. Pat. No. 3,085,297 discloses several embodiments of a complex door mechanism for a pressurized airplane cabin which is of interest with regard to the linkage which is used to achieve a 180° door opening, particularly the first embodiment of FIGS. 1–11 and the second embodiment of FIGS. 12–18. These aircraft doors operate differently from the doors with which the present invention is concerned in that it is necessary first to "unplug" the door which has been hermetically sealed to the fuselage (by moving it inwardly), after which the door is then "sidled" out through the opening and finally is swung around about 180° near the outer surface of the fuselage.

U.S. Pat. No. 3,651,539 shows a hinge construction wherein the hinge member on which the door is pivoted is held in a retracted position by a latch against the force of a compression spring while the door is closed. When the door starts to open the latch is disengaged; the hinge member moves outwardly perpendicularly to the plane of the door frame to move the door pivot axis out beyond the frame, and the door can then be opened 180°.

In all of the foregoing prior art constructions the hinge mechanism is recessed into the door jamb, works through the door jamb, or is otherwise closely associated with or adjacent the jamb. In the present invention such is not the case. Instead the hinge mechanism is mounted so that it is spaced away from the door jamb in confronting relation therewith.

SUMMARY OF THE INVENTION

A hinge mechanism for a door which is adjacent a jamb when the door is closed, which includes a bracket mounted in fixed spaced relation with the jamb. A hinge member is pivotally mounted on the bracket and extends toward the jamb in the door closed position, and a link likewise is pivotally mounted on the bracket. A pivot arm is pivotally connected at the distal ends of both the hinged member and the link and a spring is connected to the pivot arm. Pivotal mounting for a door is located at the distal end of the hinge member.

DESCRIPTION OF THE PREFERRED EMBODIMENTS

Figure 1:
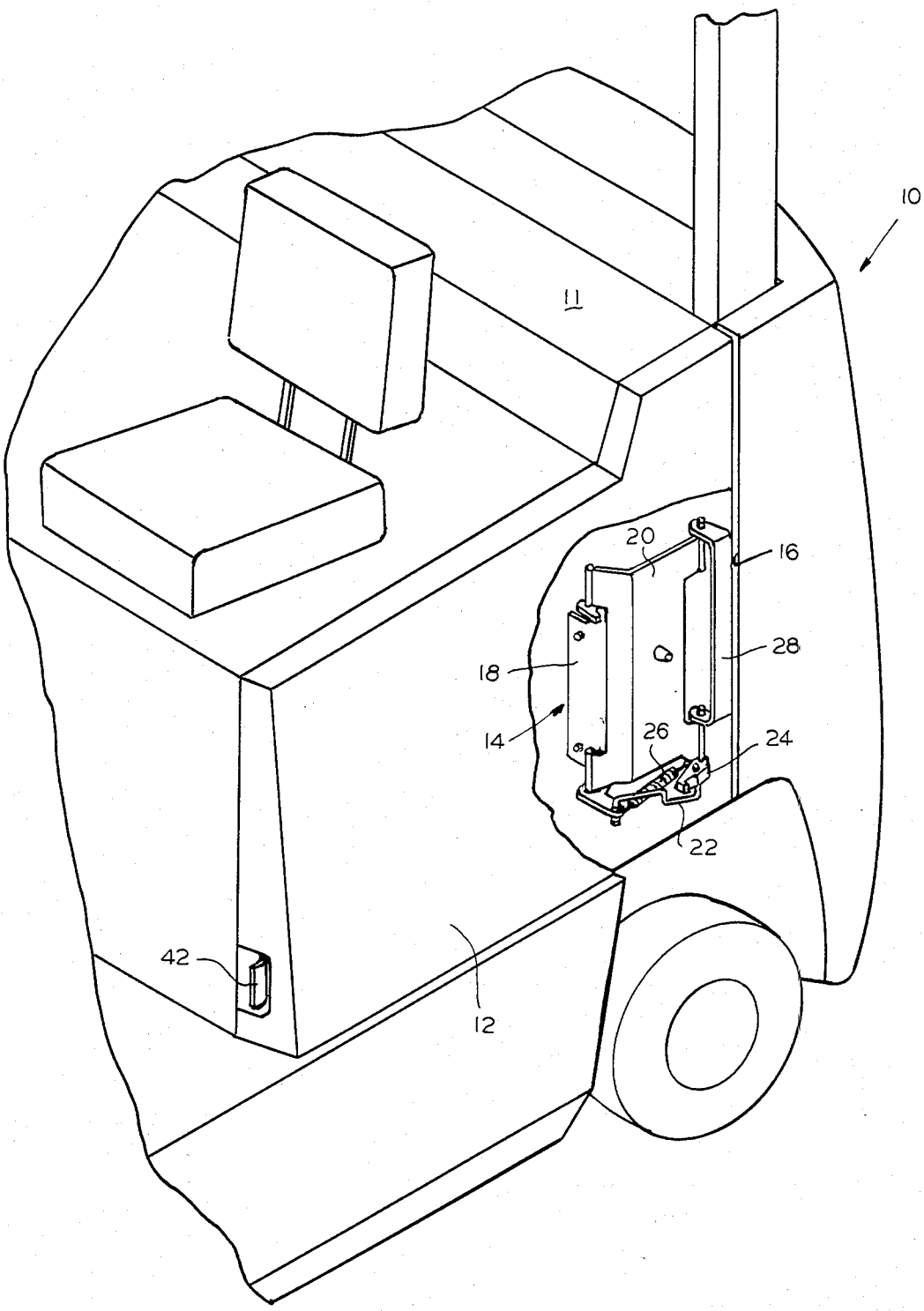
FIG. 1 is a perspective view, with the door panel partially cut away, of one embodiment of the mechanism of this invention.

The first embodiment shows the use of this invention for a door which forms a side panel of a fork lift truck, and is illustrated in FIGS. 1, 2, 3A, 3B, 3C, 4, 5A and 5B of the drawing. FIG. 1 shows a partial perspective view of the side of a fork lift truck indicated generally by the numeral 10. The door is indicated at 12. The hinge mechanism of this invention indicated generally at 14 is housed inside the door 12 when the door is closed. FIG. 1 shows part of the door 12 broken away so that the hinge mechanism may be observed.

Figure 2:
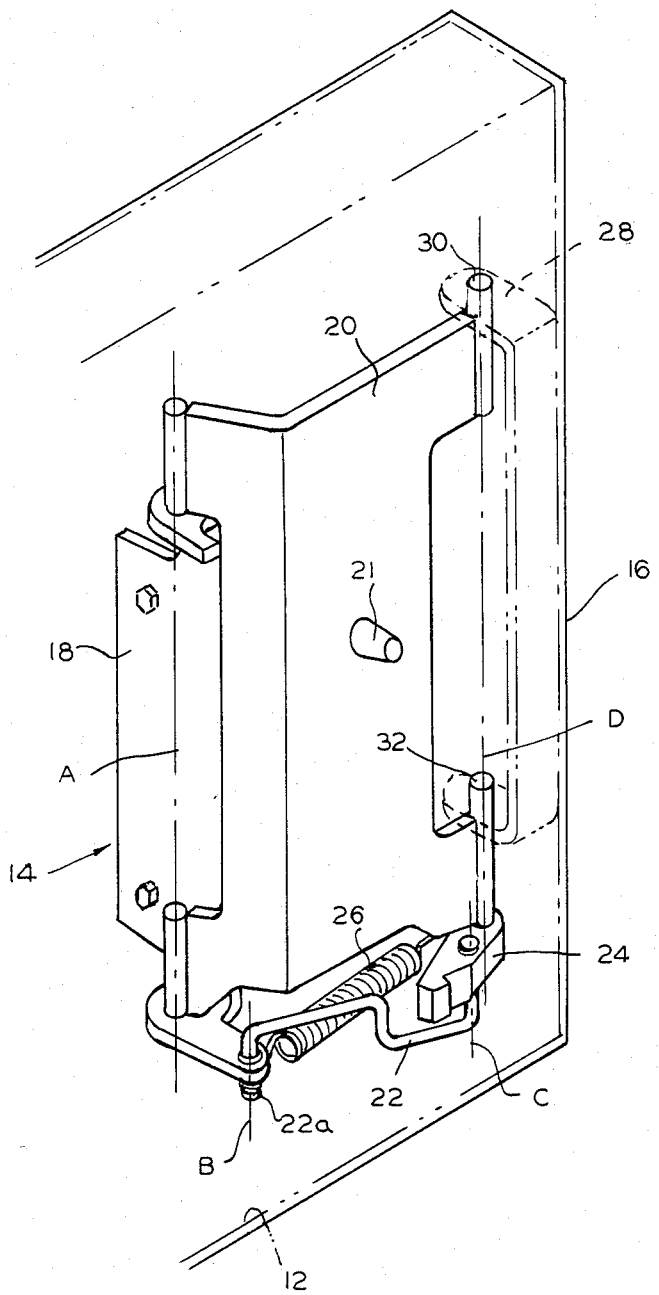
FIG. 2 is an enlarged view of the mechanism of FIG. 1.
Figure 3A:
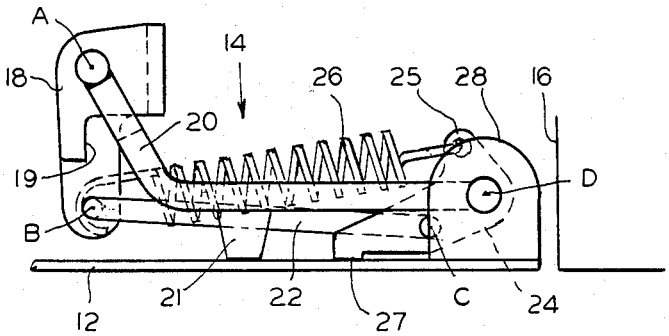
FIG. 3A is a top plan view of the same mechanism in the door closed position.
Figure 3B:
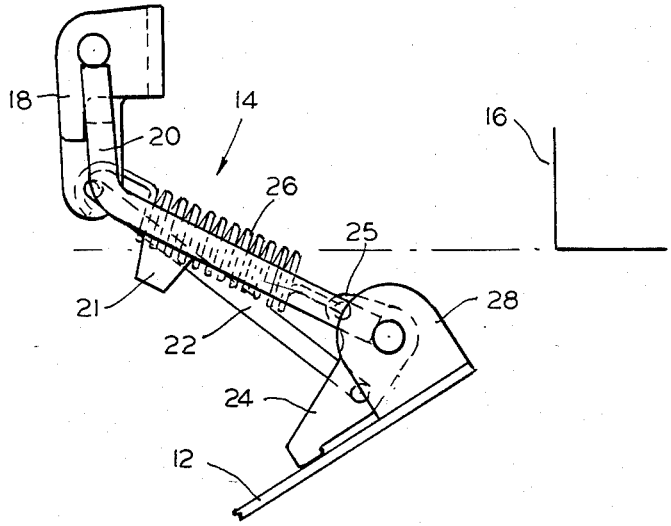
FIG. 3B is a top plan view of the same mechanism with the door in a partially open position.
Figure 3C:
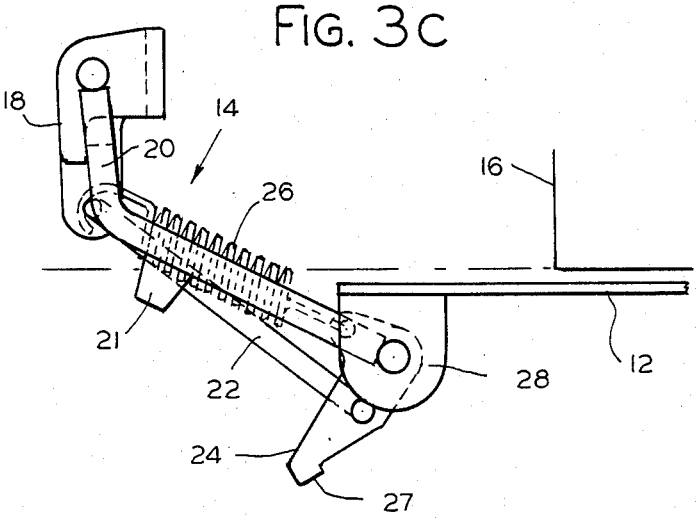
FIG. 3C is the same mechanism with the door in the fully opened position.
Figure 4:
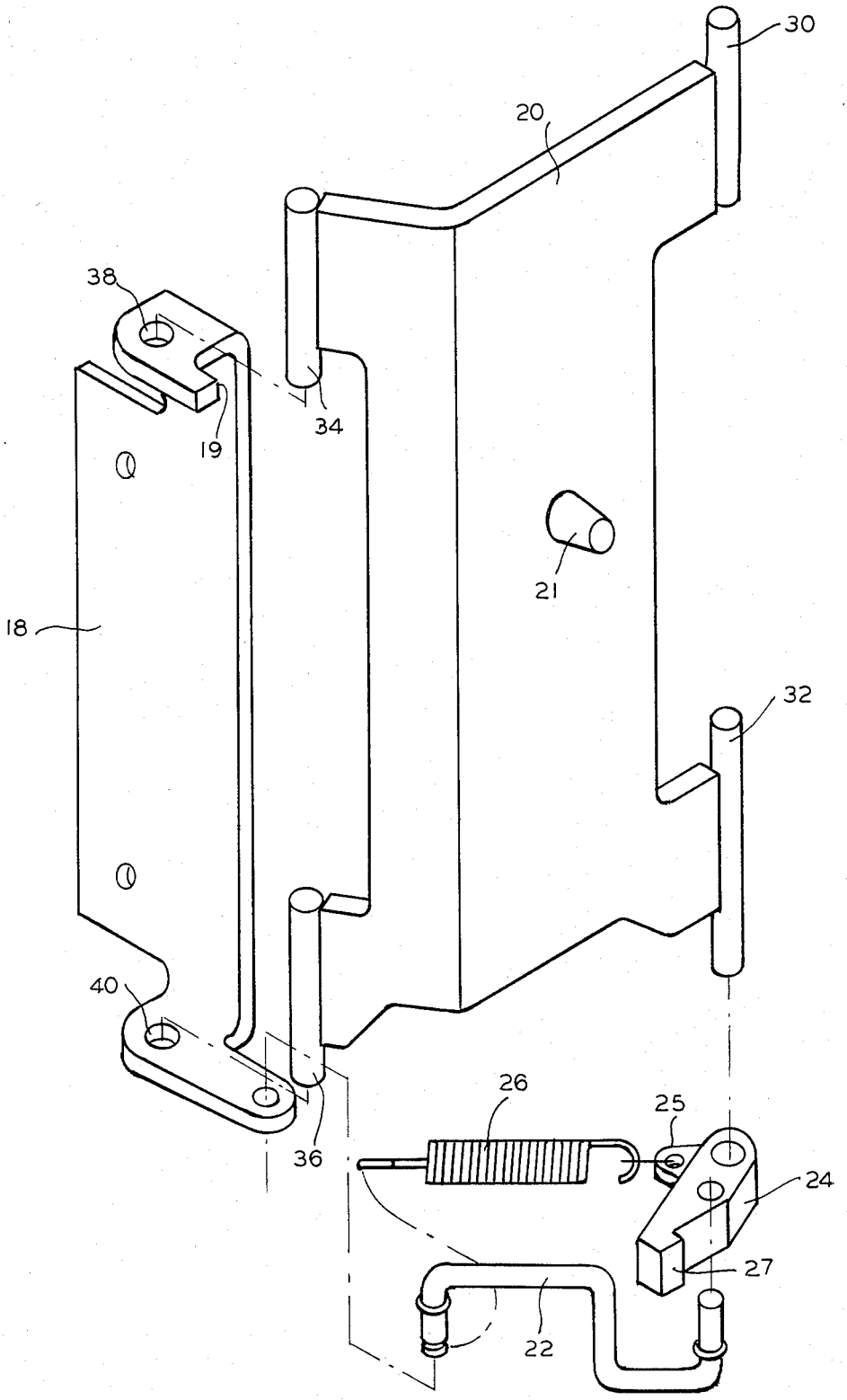
FIG. 4 is an exploded view of the principal parts of the mechanism of the first embodiment.

FIG. 2 shows a larger view of the hinge mechanism 14 from the same perspective, while FIGS. 3A, 3B and 3C show top views of the mechanism in three different positions and FIG. 4 shows an exploded view of the parts comprising the hinge mechanism. There is an opening in the side of the body of the vehicle 10 which the door 12 covers and this opening includes a jamb 16 along one side.

The hinge mechanism 14 includes a support bracket 18 which is mounted in fixed spaced relation with jamb 16. In the vehicle 10 illustrated both the bracket 18 and body portion 11 of the vehicle 10 which includes the jamb 16 are mounted on the vehicle frame. A hinge member 20 is mounted on bracket 18 to pivot about an axis A. See FIG. 2. Also pivotally mounted on bracket 18 is a link 22 which pivots about axis B.

A pivot arm 24 is pivotally mounted at the distal ends of both hinge member 20 and link 22. See FIG. 3A for a plan view of the shape of this pivot arm. The pivot arm 24 includes a projection 25, and a spring 26 is connected between projection 25 and the downwardly projecting end 22*a* of link 22 where link 22 is pivotally attached to bracket 18. The pivot arm 24 pivots with respect to the link 22 about axis C and with respect to hinge member 20 about axis D.

The door 12 is pivotally mounted on hinge member 20 by means of an internal bracket 28 (see FIG. 2) on the door which is supported by a gravity connection when openings in the bracket 28 are placed on projections 30 and 32 extending upwardly from hinge member 20. These upward projections which may be seen best in FIG. 4 are coaxial with axis D. Hinge member 20 is mounted on bracket 18 by means of a gravity connection wherein the downward projections 34 and 36 on hinge member 20 project into openings 38 and 40 respectively as may be seen in FIG. 4. Projections 34 and 36 define axis A.

FIGS. 3A, 3B and 3C show the hinge mechanism 14 in the door closed, intermediate and door open positions respectively. The door 12 and the mechanism 14 are held in the position of FIG. 3A by means of a door latch 42, which can be seen in FIG. 1, which automatically latches when the door 12 is pushed to the closed position shown in FIG. 1. When latch 42 is manually released the door 12 and mechanism 14 move to the position shown in FIG. 3B through the action of spring 26 which is under tension in the condition of FIG. 3A. When the latch is released the tension causes the hinge mechanism to move to the position of FIG. 3B. This position is determined by an abutment 19 on bracket 18 which abutment is contacted by hinge member 20 when the intermediate position of FIG. 3B is reached.

Figure 5A:
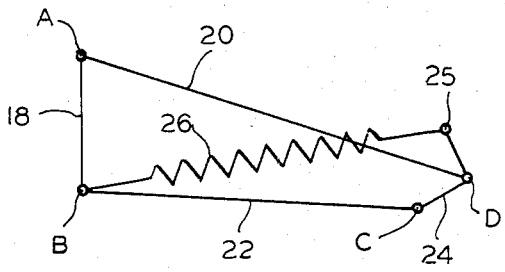
FIGS. 5A and 5B are diagrams to illustrate the action of the hinge mechanism, which correspond respectively to FIGS. 3A and 3B.
Figure 5B:
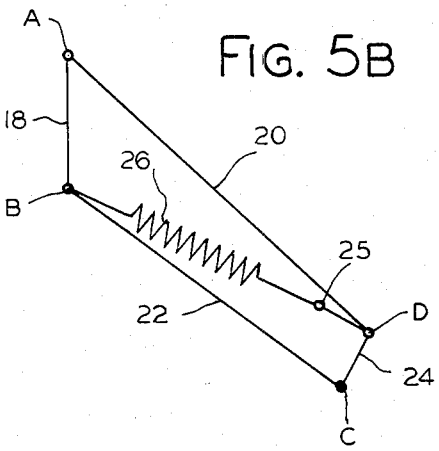

FIGS. 5A and 5B provide simpler diagrams to illustrate the action of the hinge mechanism. These two figures correspond to the positions of FIGS. 3A and 3B respectively and illustrate how the four-bar linkage made up of bracket 18, hinge member 20, link 22 and the pivot arm 24, which after being held in the door closed position by latch 42 with spring 26 under tension, moves to the intermediate door position when latch 42 is released. In moving from the door closed position of FIG. 5A to the intermediate position of FIG. 5B pivot axis D follows an arcuate path about axis A, such movement having one component across the door opening away from the jamb 16 and another component outwardly of the door opening.

When the mechanism 14 is in the intermediate position of FIG. 3B the door 12 can be moved to the 180° open position illustrated in FIG. 3C merely by pivoting the door manually on projections 30 and 32 on the hinge member 20. In the intermediate position or the full 180° open position or anywhere in between these two positions the door 12 can be readily removed merely by lifting the inside bracket 28 off of projections 30 and 32. The door can be replaced again by the reverse of the same procedure.

When the door is in the intermediate position of FIG. 3B and it is desired to close it to the position illustrated in FIG. 3A the side of the door away from jamb 16 may be pushed inward manually. In the intermediate position door 12 contacts an abutment 27 on pivot arm 24 which, as the door is pivoted inwardly from FIG. 3B to FIG. 3A, causes pivot arm 24 to pivot clockwise and spring 26 to be subjected to increased tension. When door 12 has reached the closed position of FIG. 3A it contacts a suitable drop 21 of rubber or other equivalent resilient material which acts as a stop for the door and in cooperation with latch 42 holds the door in the closed position.

Figures 6, 7:
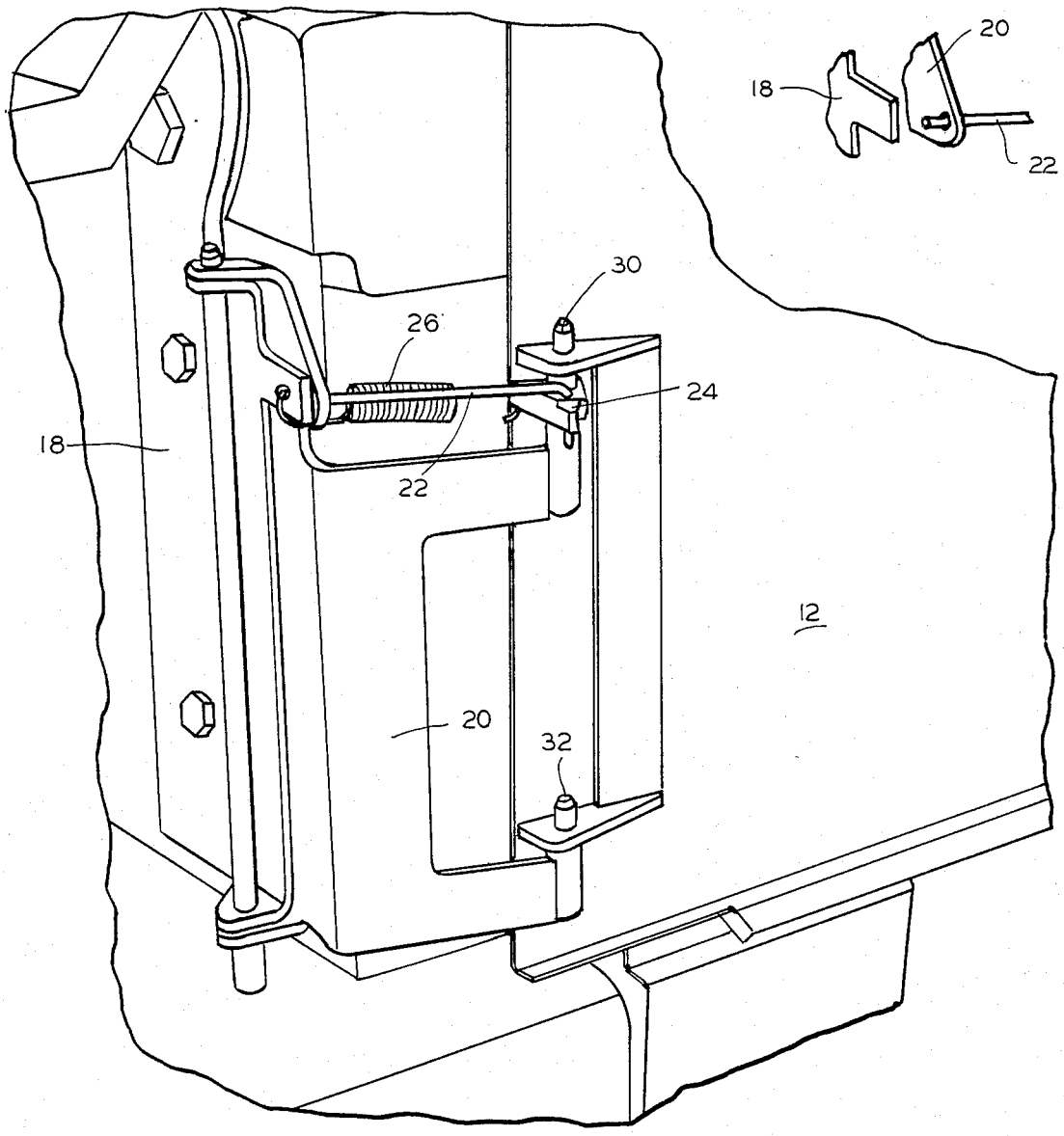
FIG. 6 is a perspective view of another embodiment of the invention.
FIG. 7 is a fragmentary view of a portion of FIG. 6.

FIG. 6 of the drawing shows another embodiment of this invention. This embodiment also is incorporated in a door construction for the side panel of a fork lift truck and shows the door 12 in the full open position. The second embodiment is essentially the same as the first embodiment and the same numbers have been utilized for the same parts in FIG. 6 as in the other figures. The principal difference in the second embodiment as compared to the first is that the link 22, the pivot arm 24 and the spring 26 are above hinge member 20 in the second embodiment in contrast to their location below the hinge member 20 in the first embodiment. Also in the second embodiment the link 22, instead of being pivoted on bracket 18, extends through an opening in hinge member 20 as shown in FIG. 7. FIG. 6 illustrates the full open position, like FIG. 3C; in this position hinge member 20 abuts bracket 18 as does the end of link 22. FIG. 7 illustrates the door closed position, corresponding to FIG. 3A; in this closed position link 22 as well as hinge member 20 have moved away from bracket 18.

While I have illustrated and described herein two embodiments of my invention including the best mode contemplated for carrying it out as shown in FIGS. 1–5B, modifications may be made. For example, it is applicable to a nonplanar door as well as to the planar doors which are shown. Accordingly, it should be understood that I intend to cover by the appended claims all such modifications which fall within the true spirit and scope of my invention.

I claim:

1. A hinge mechanism for a door which is adjacent a jamb when the door is closed, comprising a bracket mounted in fixed spaced relation with the jamb, a hinge member pivotally mounted on said bracket and extending toward the jamb in the door closed position, a link pivotally mounted on said bracket, a pivot arm pivotally connected at the distal ends of said hinge member and said link, a spring connected to said pivot arm biasing said mechanism to an intermediate position, a pivotal mounting for a door at the distal end of said hinge member, a door at the said distal end of the hinge member, a latch arranged to selectively hold said door in the closed position, and an abutment on said pivot arm which is contacted by said door as the door moves from said intermediate position to the closed position.

2. A hinge mechanism as in claim 1 which includes a resilient stop member on said hinge member which is in contact with said door when the mechanism is in the closed position.

3. A hinge mechanism as in claim 2 wherein said door can be swung freely from said intermediate position to a fully open position, pivoting on the distal end of said hinge member, without moving other parts of the hinge mechanism.

4. A hinge mechanism as in claim 3 wherein said door is mounted on said hinge member by a gravity connection and can be lifted off the hinge member without affecting the other parts of said mechanism.

5. The combination of a door opening having a jamb on one side, a door adapted to close said opening, and a hinge mechanism carrying the door for operation, comprising a support bracket mounted in fixed spaced relation with said jamb, said support bracket being inside when the door is closed, a hinge member pivotally mounted on said support bracket and extending toward said jamb in the door closed position, a link pivotally mounted on said support bracket and extending toward said jamb in the door closed position, a pivot arm pivotally connected at the distal ends of said hinge member and said link, a projection on said pivot arm, a spring connected between said projection and said support bracket in a manner to bias said hinge member to move to an intermediate door position, the distal end of said hinge member following an arcuate path having two components of motion during a move from the closed to the intermediate position, one component being toward the center of said door opening from the jamb and the other outwardly of the door opening, an abutment on said support bracket which is contacted by said hinge member when said intermediate position is reached, a double pivotal mounting at the distal end of said hinge member, said door mounted on said double pivotal mounting for swinging movement between said intermediate position and a fully open position, an abutment on said pivot arm positioned to be contacted by said door as it moves from said intermediate position to said closed position causing said pivot arm to move to the door closed position, a resilient stop on said hinge member which is contacted by said door when it reaches said closed position, and a latch on said door opposite said jamb selectively holding said door in the closed position.

6. The combination of claim 5 wherein said double pivotal mounting is the gravity type, and said door can be readily removed or replaced when the hinge mechanism is in the intermediate position or open position or in between them without breaking or making any connections.

* * * * *